US006831218B2

(12) United States Patent
Steinberger

(10) Patent No.: US 6,831,218 B2
(45) Date of Patent: Dec. 14, 2004

(54) STRINGED MUSICAL INSTRUMENT

(76) Inventor: R. Ned Steinberger, 420 Hill Top Rd., Nobleboro, ME (US) 04555

( * ) Notice: Subject to any disclaimer, the term of this patent is extended or adjusted under 35 U.S.C. 154(b) by 0 days.

(21) Appl. No.: 10/339,586

(22) Filed: Jan. 9, 2003

(65) Prior Publication Data

US 2003/0145712 A1 Aug. 7, 2003

Related U.S. Application Data

(60) Provisional application No. 60/347,370, filed on Jan. 11, 2002.

(51) Int. Cl.[7] ..... G10D 3/00

(52) U.S. Cl. ..... 84/293; 84/291; 84/267

(58) Field of Search ..... 84/293, 291, 267

(56) References Cited

U.S. PATENT DOCUMENTS

| | | | |
|---|---|---|---|
| 14,378 | A | 3/1856 | Tilton |
| 294,832 | A | 3/1884 | Wichard |
| 454,905 | A | 6/1891 | Geiger |
| 466,501 | A | 1/1892 | Lyon |
| 478,933 | A | 7/1892 | Henning |
| 516,717 | A | 3/1894 | Anderberg |
| 519,416 | A | 5/1894 | Turner |
| 538,679 | A | 5/1895 | Howe |
| 601,071 | A | 3/1898 | Borcur |
| 608,279 | A | 8/1898 | Benson |
| 621,700 | A | 3/1899 | Olson |
| 738,811 | A | 9/1903 | Johnson |
| 976,428 | A | 11/1910 | Benson et al. |
| 1,010,240 | A | 11/1911 | Degulio |
| 1,446,758 | A | 2/1923 | McHugh |
| 1,567,359 | A | 12/1925 | De Wick |
| 1,611,648 | A | 12/1926 | Lange |
| 1,633,574 | A | 6/1927 | Dewey |
| 1,671,942 | A | 5/1928 | Strupe |
| 1,707,192 | A | 3/1929 | Overton |
| 1,754,263 | A | 4/1930 | Claiborne |
| 1,755,019 | A | 4/1930 | Parker, Jr. |
| 1,764,679 | A | 6/1930 | Gast |
| 1,768,261 | A | 6/1930 | Larson |
| 1,818,631 | A | 8/1931 | Larson |
| 1,889,408 | A | 11/1932 | Larson |
| 1,932,975 | A | 10/1933 | Kuhrmeyer |
| 2,335,244 | A | 11/1943 | Gugino |
| 2,497,116 | A | 2/1950 | Dopyera |
| 2,614,448 | A | 10/1952 | Maccaferri |
| 2,737,842 | A | 3/1956 | Polfuss |
| 2,793,556 | A | 5/1957 | Maccaferri |
| 2,795,988 | A | 6/1957 | Maccaferri |
| 3,072,007 | A | 1/1963 | Burke |
| 3,143,028 | A | 8/1964 | Fender |
| 3,185,011 | A | 5/1965 | Anderson |
| 3,196,730 | A | 7/1965 | Daniel |

(List continued on next page.)

FOREIGN PATENT DOCUMENTS

| | | | |
|---|---|---|---|
| DE | 40 19 376 A1 | | 1/1991 |
| DE | 4019376 | * | 1/1991 |

*Primary Examiner*—Shih-Yung Hsieh
(74) *Attorney, Agent, or Firm*—Lerner, David, Littenberg, Krumholz & Mentlik, LLP

(57) ABSTRACT

A stringed musical instrument having an instrument body and a neck extending in a longitudinal direction outward from the body. Strings attach at their first end to the instrument body and at their second end to the neck. The neck is attached to the body via a holding member extending at least partially through the neck and the instrument body while permitting the neck to be pivotable about a fulcrum on the body. The stringed musical instrument further includes a moveable adjustment member arranged so as to be moveable in a predetermined manner to adjust the angular position of the neck relative to the instrument body wherein the moveable adjustment member includes a finger manipulable portion to move the adjustment member in the predetermined manner. The finger manipulable portion may be located within a recess provided in the instrument body or within a hollow sound chamber within the instrument body.

31 Claims, 5 Drawing Sheets

U.S. PATENT DOCUMENTS

| | | | | | |
|---|---|---|---|---|---|
| 3,204,510 | A | | 9/1965 | Hopf | |
| 3,251,257 | A | | 5/1966 | Bunker | |
| 3,302,507 | A | | 2/1967 | Fender | |
| 3,353,433 | A | | 11/1967 | Webster | |
| 3,418,876 | A | | 12/1968 | Dopyera | |
| 3,538,807 | A | | 11/1970 | Francis | |
| 3,550,496 | A | | 12/1970 | Fender | |
| 3,563,126 | A | | 2/1971 | Connington | |
| 3,858,480 | A | | 1/1975 | Schneider et al. | |
| 3,911,778 | A | | 10/1975 | Martin | |
| 4,027,570 | A | | 6/1977 | Rendell et al. | |
| 4,044,644 | A | | 8/1977 | Mussulman | |
| 4,084,476 | A | | 4/1978 | Rickard | |
| 4,111,093 | A | * | 9/1978 | Field et al. | 84/267 |
| 4,126,073 | A | | 11/1978 | Takabayashi | |
| 4,172,404 | A | | 10/1979 | Dopyera | |
| 4,172,405 | A | | 10/1979 | Kaman, II | |
| 4,228,715 | A | | 10/1980 | Nourney | |
| 4,335,641 | A | | 6/1982 | Höpf | |
| 4,411,186 | A | | 10/1983 | Faivre | |
| 4,432,267 | A | | 2/1984 | Feller | |
| 4,557,174 | A | | 12/1985 | Gressett, Jr. | |
| 4,656,915 | A | | 4/1987 | Osuga | |
| 4,768,415 | A | | 9/1988 | Gressett, Jr. et al. | |
| 5,018,423 | A | | 5/1991 | Bunker et al. | |
| 5,025,695 | A | | 6/1991 | Viel | |
| 5,353,672 | A | * | 10/1994 | Stewart | 84/291 |
| 5,421,233 | A | | 6/1995 | Bunker | |
| 5,458,035 | A | | 10/1995 | Okamura | |
| 5,549,027 | A | | 8/1996 | Steinberger et al. | |
| 5,679,910 | A | | 10/1997 | Steinberger et al. | |
| 5,786,539 | A | | 7/1998 | Steinberger | |
| 6,265,648 | B1 | | 7/2001 | Steinberger | |

* cited by examiner

STRINGED MUSICAL INSTRUMENT

CROSS-REFERENCE TO RELATED APPLICATIONS

The present application claims the benefit of U.S. Provisional Patent Application Ser. No. 60/347,370, filed Jan. 11, 2002, the disclosure of which is hereby incorporated by reference.

BACKGROUND OF THE INVENTION

The present invention relates to stringed musical instruments of the type which include an instrument body, a neck extending therefrom and a plurality of strings attached at one end to the instrument body and at the other end to the neck. More particularly, the present invention is directed to an improved system for mounting the neck of the instrument to the instrument body in a manner so that the orientation of the neck can be easily, quickly and accurately adjusted. The stringed musical instruments in accordance with the present invention may include guitars, such as acoustic guitars, solid body electric guitars and acoustic electric guitars, but may also include other such stringed musical instruments such as, for example, banjos, mandolins, violins, lutes and/or other similar instruments. Although the principles of the present invention will be described herein in connection with guitars, and mainly acoustic guitars, it should be understood that the principles disclosed are also applicable to other types of guitars and other stringed instruments which have an instrument body and an elongated neck along which the strings are stretched.

Stringed musical instruments of the type with which the present invention is concerned typically include an instrument body and an elongated neck along which the strings are stretched. In a guitar, the strings are attached at one end to the neck of the instrument. This attachment is typically by means of tuning keys or tuning machines provided on the end of the neck remote from the instrument body, often termed the "head" of the guitar. The strings then extend over a "nut" provided at the head end of the neck and extend along the neck toward the body. The other ends of the strings are attached either directly to a bridge which in turn is mounted on the body, or to a tailpiece provided behind the bridge mounted on the body and over which the strings extend. In the play of the instrument, the player moves his fingers up and down the neck, clamping the strings so as to shorten them and create various pitches as the strings are strummed, plucked, or otherwise excited. Typically, the neck of the instrument may be covered with a fingerboard which may carry frets thereon extending across the width of the neck so as to provide a means for anchoring the ends of the shortened strings at definite or desired locations.

In the case of an acoustic instrument, such as an acoustic guitar, the body of the instrument encloses a resonant sound chamber. Strumming, plucking or otherwise exciting the strings causes the strings to vibrate. This vibration in turn causes the bridge over which the strings extend to vibrate as well. In fact, the bridge forms the vibrating end point of the strings for every note that is played. Vibration of the bridge in turn causes the top of the acoustic instrument, known as the soundboard, to vibrate. Such vibration causes air entrapped within the sound chamber to move and generate the sound heard upon play of the instrument.

In the case of electric guitars, the instrument body is usually solid, and pickup devices are utilized to convert the string vibration into sound generated by an amplifier or the like. Some types of electric guitars are acoustic electric guitars which will function as an acoustic guitar but can also be provided with a pickup so that the acoustic sound is amplified.

There are three general kinds of neck joints which have been used in stringed musical instruments. "Neck-through" instruments have a neck which extends completely through the instrument, and are almost always permanently glued in place. "Set-neck" instruments have a neck which is also permanently glued in place, with a tenon or dovetail joint where the body meets the neck. These instruments usually have a neck heel just forward of the body which extends down to the back of the body to provide support. Finally, there are "bolt-on" instruments which have an opening in the body where the neck overlaps the body, and where bolts are located which join the neck to the body. Generally, in this type of instrument, the neck joint is made solid so that no movement between the neck and body is possible during use of the instrument. However, the bolts can be loosened so that the neck can be removed from or repositioned in the body.

Acoustic guitars are traditionally set-neck instruments, with a neck heel just forward of the body and extending down to the back of the body. This forward protrusion beneath the neck adjacent the body restricts access to the highest region of the fingerboard during play. Electric guitars are commonly either set-neck instruments or bolt-on instruments. Common bolt-on instruments are economical to construct and repair. However, the drawbacks of the existing bolt-on designs are that the joint has less side-to-side rigidity than glued necks, and access to the highest region of the front of the fingerboard, near the body, is restricted by the body portion extending under the overlap of the neck.

As the bridge of a stringed musical instrument forms the vibrating end point of the strings for every note that is played, it is therefore extremely influential in determining the sound quality of the instrument. In this regard, it is important that the bridge be securely fastened to the top of the body so that it is fixed in place in order to ensure that energy from the vibrating strings is not needlessly lost. Even with solid body electric guitars, the bridge of the instrument still forms the end point of the strings for every note. A loose fitting bridge or one which is not securely fastened to the top will adversely affect the sound quality of the instrument. Also, anything that affects the position of the bridge—longitudinally, laterally, or the height above the top of the instrument—can affect the sound quality of the instrument (as convenient nomenclature in describing the present invention, the term "longitudinal" is used to denote a direction generally parallel to the direction that the strings extend, and the term "lateral" is used to denote a direction normal thereto but lying generally in or parallel to the plane of the strings. Similarly, the terms "downward" and "vertical" are used to denote a direction generally normal to the plane of the strings and thus normal to the surface of the top of the guitar).

The height or spacing of the strings above the fingerboard, often referred to as "action," is generally controlled by the height of the bridge and of the nut, as well as the angularity of the top surface of the neck relative to the instrument body. In this regard, tilting of the neck downwardly relative to the guitar body serves to bring the strings closer to the fingerboard, and thus lowers the action. Conversely, tilting of the neck upwardly relative to the body tends to move the strings further away from the fingerboard, thus raising the action. The string/fingerboard spacing is generally a matter of personal preference for the player. However, there is a generally defined range or window of desirable action as no player wants an instrument having an excessively high or an excessively low action. The preference is for the player to be able to maintain the action of the instrument as desired. Thus, a limited degree or amount of adjustability of the string/fingerboard spacing is desirable, not only to accommodate individual preferences, but also to accommodate changes in the guitar's response to the effects of time and environment.

The harmonic length of the individual strings of the instrument is generally determined by the distance between the bridge of the instrument located on the body and the nut which is located on the end of the neck remote from the body. Typically, the nut serves as the base reference point in counting the frets, such that the nut is the "zero" fret. The head of the neck may conveniently be angled away or downwardly relative to the fingerboard so as to ensure that the strings rest against the nut and then extend freely over the fingerboard to the bridge. The intonation or harmonic tone of the strings can be changed or adjusted by changing the distance between the bridge and the nut or other anchor point for the strings.

In many solid body electric guitars, the bridge elements may be adjustable longitudinally toward and away from the nut to adjust the intonation of the individual strings. Also, the overall bridge of the instrument may be mounted so as to be moveable longitudinally. In addition, in some instances, the bridge saddles or string support elements may be moved vertically as well to adjust the height or action of the strings. Although adjustable bridges have commonly been employed with electric guitars with satisfactory results, subtle improvements in tone and/or new piezo bridge pickup technologies make the use of a fixed, non-adjustable bridge desirable.

For acoustic guitars, it generally is undesirable to provide an adjustable bridge. Since sound in acoustic guitars is accomplished by driving the soundboard as a result of string vibration, it is desirable to keep the weight of the bridge as light as possible. Adjustable bridges tend to increase the weight, thus changing the overall sound quality and impacting on the soundboard serving as an effective sound diaphragm in an acoustic guitar. Moreover, the presence of moving parts in the bridge can lead to instability which may degrade the sound quality of the instrument.

Accordingly, for these types of reasons as well as the issue of tone quality, most acoustic guitars utilize a fixed, non-adjustable bridge. Moreover, the action (as well as the intonation) of most acoustic stringed musical instruments is set at the factory, and is not readily changeable in the field. This is a significant deficiency of these types of instruments since different players prefer different settings for the action. Furthermore, the wood of which most guitars and the like are constructed is an unstable material, and the action of the instrument tends to vary with atmospheric conditions. For instance, an increase in the humidity tends to cause the top of the instrument to rise due to swelling of the wood, which in turn increases the action of the instrument. Moreover, the top of an acoustic guitar moves up and down seasonally and as it ages.

Consequently, acoustic instruments without action adjustment present a constant problem in that they need to be returned on a periodic basis to the manufacturer or to the place that they were purchased for adjustment. Such instruments may need to be returned to the manufacturers by the dealer/retail establishment prior to any sale. Although the intonation of an acoustic stringed musical instrument is not as sensitive to variations in atmospheric conditions or time, any changes in intonation which may be desired also typically require return of the instrument to allow relocation of the position of the bridge on the soundboard. It will be appreciated that any return of the instrument, either before it is ever sold by the dealer or when it is returned to the dealer for periodic adjustment, costs time and money.

Therefore, a strong need remains for a system for mounting the neck of a stringed musical instrument to the instrument's body in a manner so as to provide for easy and rapid adjustment of the position of the neck relative to the body, and in particular, adjustment of the action of the instrument.

Providing an adjustable neck may provide significant cost savings. For instance, while on display, dealers will be able to maintain optimal action for the instrument irrespective of the seasonal climate, and will be able to adjust the action to meet specific customer preferences at the time of sale. At the factory, providing an adjustable neck joint or system for mounting of the neck to the guitar would permit acoustic guitars to be assembled from complete, pre-finished body and neck sub-assemblies, and then quickly adjusted for ideal intonation and/or action. In this regard, one of the most significant causes of problems and returns of musical instruments concerns the action height, which heretofore could not be easily, rapidly and accurately adjusted. Further, providing an adjustable neck permits one to maintain the height of the bridge on the acoustic instrument without change, which has an important effect on the tonal response for the instrument. Further still, an adjustable neck may be manipulated to accommodate the preferred action level despite varying atmospheric conditions and age changes of the instrument over time. Furthermore, the action could be tweaked just before a performance or even between songs if desired. Moreover, with acoustic electric instruments, which may be used either as an acoustic instrument or an electric instrument, providing an easily and quickly adjustable neck would enable a musician to shift in the field from an acoustically powerful high action to a low electric action in a short time. This would allow the acoustic electric instrument to be adjusted optimally for either acoustic play or electric play, providing a level of versatility that guitars have never known.

As described in applicant's prior U.S. Pat. No. 6,265,648 B1, the disclosure of which is incorporated herein by reference, there are numerous examples in the prior art of devices and systems for adjusting the action of a stringed musical instrument. Applicant's prior patent improves upon the prior art in that it provides for action adjustment, and in preferred embodiments, intonation adjustment and rigid, stable mounting arrangements, in an easy, rapid and economical manner.

In particular, applicant's prior invention is directed to providing a spring loaded clamping device for securing the neck of a stringed instrument to the body while permitting limited pivotal movement of the neck relative to the body. The clamping device includes a spring arranged to provide a biasing force for urging the neck toward a neck seating position on the body, and an adjustment member moveably mounted on either the neck or the body so as to move in a direction opposing the biasing force of the spring in order to cause the neck to pivot away from the neck seating position, to thereby adjust the angular position of the neck relative to the body to adjust the action of the instrument. In preferred embodiments, U.S. Pat. No. 6,265,648 B1 also provides an intonation adjustment mechanism for adjusting the intonation of the instrument with rigidity enhancement by urging the neck against a side of a neck recess to provide a firm, rigid and stable mounting of the neck to the body.

Although U.S. Pat. No. 6,265,648 B1 provided the aforementioned beneficial improvements, as it will be appreciated from the discussion hereinbelow, the present invention provides considerable further improvements, particularly in the area of ease of use, quickness, and aesthetics.

SUMMARY OF THE INVENTION

In accordance with one aspect of the present invention, there is provided a stringed musical instrument which comprises an instrument body, a neck extending outwardly from the instrument body and arranged to pivot on a fulcrum relative to the body, a plurality of strings attached at one end to the body and at the other end to the neck, at least one holding member for securing the neck to the body while permitting limited pivotal movement of the neck relative to the body, and an adjustment member operatively engaging the neck and the body and arranged so as to be moveable in a predetermined manner to adjust the angular position of the neck relative to the body to thereby adjust the position of the strings relative to the neck. The adjustment member further includes a finger manipulable portion which is adapted to be engaged by the digits of a human hand to move the adjustment member in the predetermined manner.

Specifically, the present invention is directed to providing an easy, tool-less, rapid action adjustment while accomplishing same in an economical manner without providing inherent instability for the instrument. For example, in one embodiment, the action of the guitar may be adjusted by means of a finger manipulable thumbwheel provided on an adjustment member of the type shown in Applicant's U.S. Pat. No. 6,265,648 B1, which is located within the guitar's hollow sound chamber. Locating a fully complete adjustment mechanism within the guitar's hollow sound chamber is advantageous as there are no tools to lose. Further, even if the adjustment tool were not lost, action adjustment in accordance with the prior art often proved difficult in low light conditions, such as on stage during a performance, because the requisite tool would have to align with the adjustment member. Because the finger manipulated thumbwheel of the present invention can always be found at the installed location, locating the thumbwheel is intuitive and completely natural, even in the low-light conditions typically found in a performance venue.

Access to the thumbwheel is provided through the sound hole. It will be appreciated that the placement in such a location of a thumbwheel large enough to be finger manipulable allows for a quick adjustment of the guitar's action by a musician without the need for tools. Such an adjustment is so quick and easy that it may be performed on stage between songs during a performance. Further, as mentioned, the position and adjustment of the thumbwheel is completely intuitive. One need not even look at the thumbwheel to locate its position and rotate it the requisite amount for a predetermined adjustment degree. As such, complete adjustment is extremely quick and extremely easy.

Finally, because adjustment is so easy, no special skill is required to adjust the action by means of the present invention. The action may even be adjusted by relatively unskilled retailers at the point of sale, saving valuable time and money over some of the prior art, where action adjustment was either performed at the factory or required special expertise.

Of course, the enlarged finger manipulable thumbwheel could also be provided on other types of adjustment members for adjusting the tilt or action of the neck and which may not employ all of the elements or features of applicant's prior invention described in U.S. Pat. No. 6,265,648 B1. The important aspect in connection with the present invention is that the enlarged thumbwheel or other finger manipulable element is utilized to rotate or otherwise adjust movement of the adjustment member to effect adjustment of the action of the neck. In the case of acoustic guitars having a hollow sound chamber, the thumbwheel is preferably mounted to the adjustment member so as to be located within the hollow sound chamber and to be accessible through the sound hole. In other instruments, such as solid electric guitars, the finger manipulable element may be located below the body of the instrument or within a recess provided within the instrument body. Additional mounting locations may also be provided.

DETAILED DESCRIPTION

Figure 1:
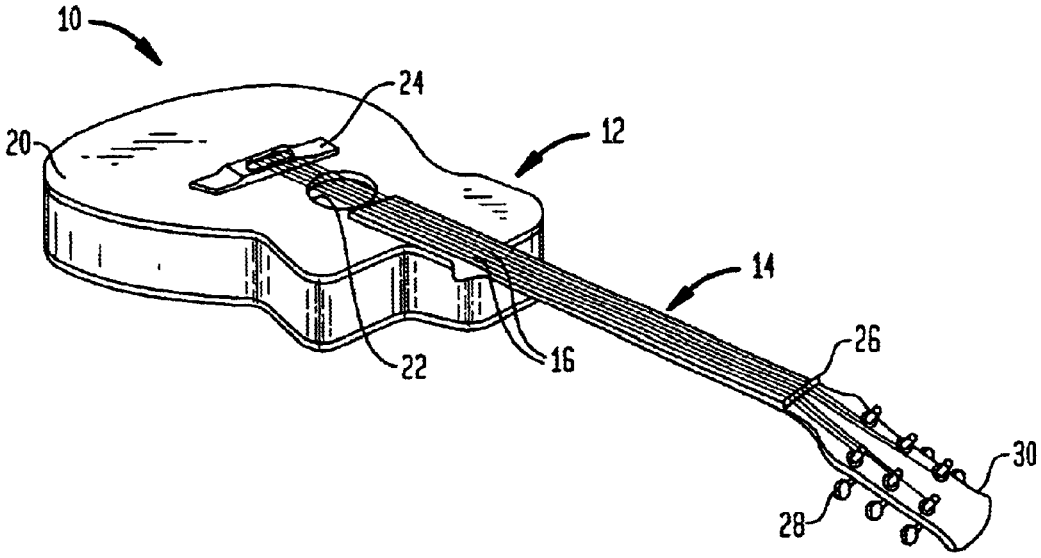
FIG. 1 is a perspective view of an acoustic guitar in accordance with one embodiment of the present invention.

Referring now to the drawings wherein like reference characters represent like elements, FIG. 1 shows a stringed musical instrument 10 in accordance with the present invention. The stringed musical instrument 10 has an instrument body 12, an elongated neck 14 secured to the body 12 and extending therefrom, and a plurality of strings 16 secured or attached at one end to the body 12 of the instrument 10 and at the other end to the neck 14. In the embodiment shown in FIG. 1, the stringed musical instrument 10 is an acoustic guitar in which the body 12 includes a hollow sound chamber 18 (shown in FIGS. 2 and 3) covered by a top soundboard 20 having a sound hole 22 exposing the hollow sound chamber. On the instrument body 12, the ends of the strings 16 are secured to a bridge element 24, which in turn is fixedly mounted on the top soundboard 20 of the guitar body 12. The strings 16 are stretched along the top of the neck 14 and pass over a nut 26 provided near the end of the neck 14. From there, the strings 16 are attached to tuning keys or tuning machines 28 provided on the head 30 of the neck 14. Typically, the head 30 is angled downwardly in order to ensure that the strings 16 are in contact with the nut 26. Along the top of the neck 14 and beneath the strings 16, there is provided a fingerboard 33 (shown in FIGS. 2 and 3) having a plurality of frets 34 (shown in FIG. 2). The frets 34 serve to provide a means by which a musician or other person may anchor the ends of the strings 16 at definite locations during play of instrument 10 to create different pitches or sounds for the strings when they are strummed, plucked or otherwise excited.

As discussed hereinbefore, the term "action" is a characteristic of the stringed musical instrument 10 relating to the spacing between the strings 16 and the fingerboard 33. Typically, the desired height of the strings 16 above the frets 34 is on the order of 1/16" for electric guitars and 1/8" for acoustic guitars, although greater or smaller distances are also typical depending upon the musician or other person who plays the instrument 10.

Of course, it will also be appreciated by those familiar with stringed musical instruments that the strings 16 could be secured to a tailpiece mounted on the guitar body 12 behind the bridge 24. Again, however, the height of the strings relative to the fingerboard 33 is still determined by the height of the bridge element 24 on the top soundboard 20, the height of the nut 26 and the angle that the neck 14 makes with the instrument 10.

The soundboard or top cover 20 of the acoustic guitar 10 serves as a sound diaphragm for the instrument, and may either be flat or arched. The neck mounting device in accordance with the present invention may be utilized with either flat top acoustic guitars or arched-top acoustic guitars, as well as with solid body electric guitars and acoustic electric guitars, and also with other stringed musical instruments of the type having a body and a neck extending therefrom along which the strings of the instrument are stretched.

Figure 2:
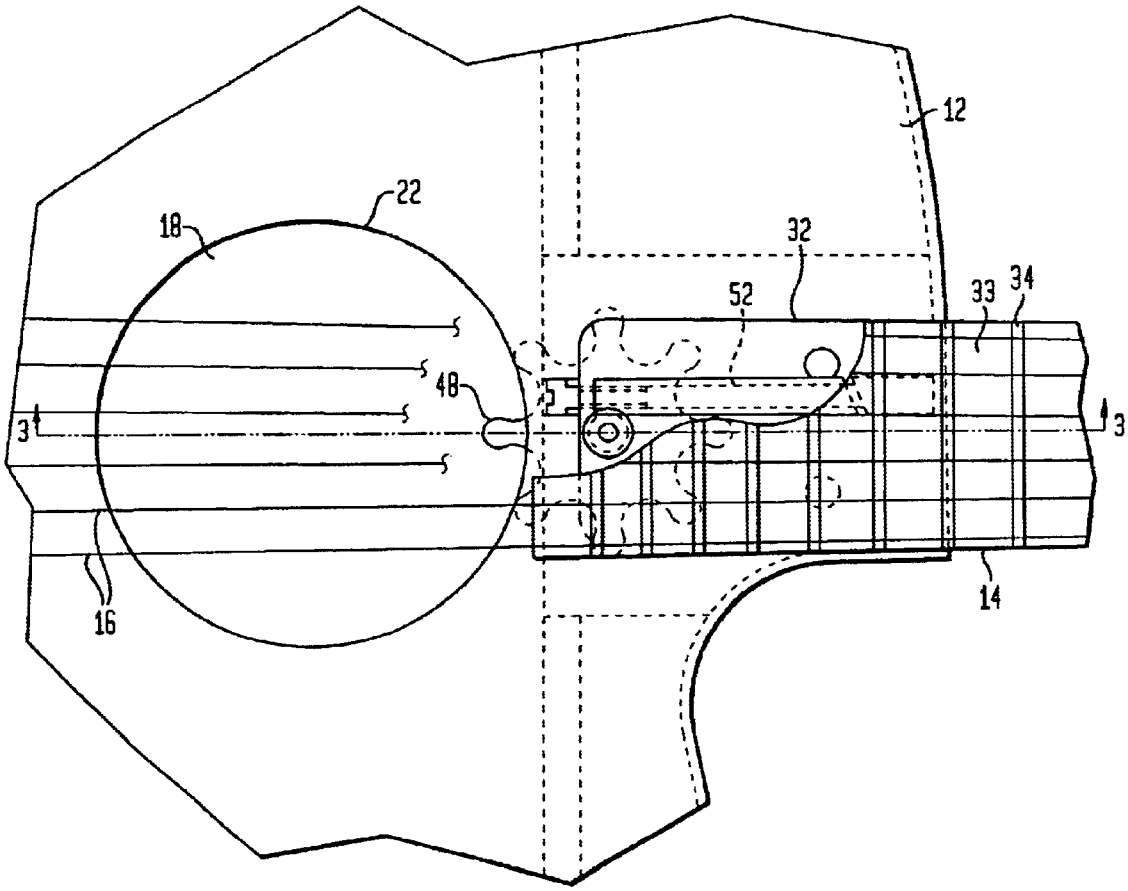
FIG. 2 is a plan view of a portion of the guitar of FIG. 1 which illustrates an embodiment of the present invention in which the moveable adjustment member is operated by a finger manipulable thumbwheel and wherein intonation adjustment is provided. Portions of FIG. 2 have been cut away for clarity.
Figure 3:
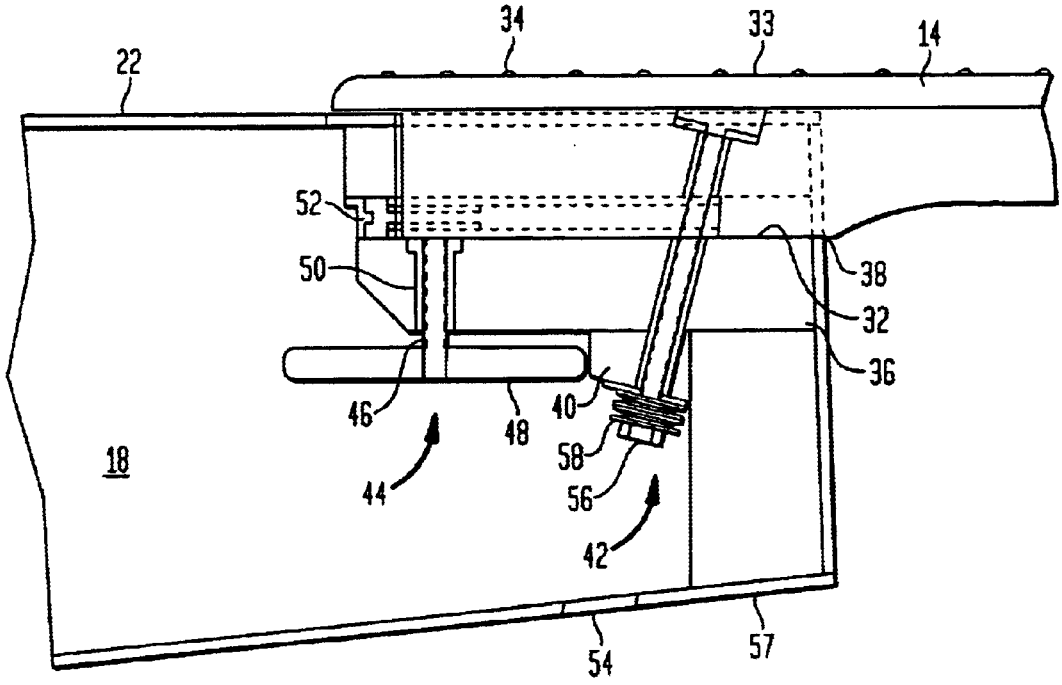
FIG. 3 is a side sectional view of the portion of the guitar shown in FIG. 2 taken along the longitudinal centerline of the instrument, and illustrating a spring biased holding member oriented at an angle relative to the neck.

In accordance with one aspect of the present invention as illustrated in FIGS. 2 and 3, the neck 14 of the guitar 10 is adapted to be mounted in a recess 32 provided in the guitar body 12. Such mounting is done in a secure and stable manner, yet permits quick and easy action adjustment. More particularly, the neck 14 is adapted to pivot or tilt about the forward edge 38 of the recess 32 in order to adjust the action of the instrument 10. The forward edge 38 of the recess 32 thus provides a fulcrum or pivot axis for the neck 14. Also, the position of the neck 14 in the longitudinal direction, i.e., the direction that the strings 16 extend, can be adjusted in a manner to be described hereinbelow to adjust the intonation of the strings 16. The intonation is determined by the harmonic length of the strings 16 which is the distance between the point at which the strings 16 are supported on the bridge 24 (FIG. 1) and the point at which the strings 16 are supported on the nut 26 (FIG. 1). It will be appreciated that with a fixed bridge 24, movement of the neck 14 in the longitudinal direction, i.e., left to right as shown in FIGS. 2 and 3, will adjust the spacing between the bridge 24 and the nut 26 to thereby change the harmonic length of the strings 16.

The recess 32 for the neck 14 is provided by means of a heel block 36 provided within the sound chamber 18 of the acoustic guitar 10 adjacent to the front end of the guitar body 12 from which the neck 14 extends outwardly. Preferably, the size of the recess 32 generally corresponds to, but is slightly larger than, the size of the neck 14 to be received therein. The heel block 36, which preferably comprises a block of wood, includes a generally rectangular recess 32 on the top thereof extending from the front edge 38 of the guitar 10 rearwardly toward the sound hole 22 provided in the top soundboard 20 and inside the sound chamber 18 within the body 12. The heel block 36, at its forwardmost end, extends to the bottom of the guitar 10 and includes a rearward extension 40. The rearward extension 40 is provided so that at least one holding member 42 (and preferably two) may be inserted at least partially therethrough and at least partially through the neck 14 in order to hold the body 12 and the neck 14 together in a firm, stable manner.

Typically, the rearward extension 40 is flat. However, in a preferred embodiment as shown in FIG. 3, the rearward extension 40 is sloped upwardly at its bottom surface to enable the holding members 42 to be inserted at an angle. Whether flat or angled, the rearward extension 40 serves as the support surface for securing the neck 14 in place through the use of the holding members 42.

The holding members 42 may consist, as in the preferred embodiment, of a bolt with a head 56. Preferably, the holding members 42 further comprise spring devices 58 disposed between the bolt head 56 and one of the neck 14 or the body 12, to provide further clamping pressure to hold the neck 14 and body 12 together. Typically, the spring device 58 will consist of at least one conical shaped spring disc, also known as a Belleville washer.

Adjustment access for the holding members 42 may be provided in a number of locations. For instance, adjustment access may be provided through the sound hole 22, such as in the case where the holding member or members 42 comprise a bolt with a nut suitable for turning by a socket wrench. Alternatively, as shown in FIG. 3, an access hole 54 may be provided in the bottom 57 of the guitar for each holding member 42 so that a suitable device, such as a socket wrench, screw driver or Allen wrench, among others, may be inserted and rotated to effect adjustment of the holding member or members 42.

An action adjustment member 44 is provided which is adapted to oppose the force created by the holding members 42 and to set the angular orientation of the neck 14. In the embodiment shown in FIGS. 2 and 3, the action adjustment member 44 is provided in the hollow sound chamber 18 and comprises a threaded screw 46 having a thumb wheel operator 48 attached thereto. Typically, the threaded screw 46 is threadably mounted in a threaded insert 50 or other suitable piece of hardware. Alternatively, the threaded screw 46 may be threaded into the guitar body 12 itself. No matter the arrangement, the threaded screw 46 protrudes through the surface of the recess 32 to contact the bottom surface of the neck 14. The neck 14 may in turn be provided with a pressure plate (not shown) to prevent damage to the neck itself and to provide a bearing surface for the load of the threaded screw 46. Rotating the action adjustment member 44 so as to increase the amount that the threaded screw 46 protrudes from the recess 32 serves to allow the rearward end of the neck 14 to move upwardly further away from the bottom surface of the recess 32, thus decreasing the spacing between the strings 16 and the fingerboard (not shown). On the other hand, rotating the action adjustment member 44 so as to retract the end, moving the end closer to the surface of the recess 32, serves to force the rearward end of the neck 14 downwardly, under the influence of the holding members 42 and the strings 16, toward the bottom surface of the recess 32, thus increasing the spacing between the strings 16 and the fingerboard (not shown). Thus, it will be appreciated that the action adjustment member 44 can be used to set the angular orientation of the neck 14 relative to the body 12, and thus the action of the guitar 10.

In the embodiment of FIGS. 2 and 3, rotation of the action adjustment member 44 is conveniently achieved by way of a thumbwheel 48 located within the hollow sound chamber 18. It will be appreciated that locating the thumbwheel 48 within the hollow sound chamber 18 serves the purpose, among others, of allowing a musician or other person who plays the instrument to adjust the action of the instrument quickly and conveniently by hand without the use of tools. Such an arrangement also permits the thumbwheel 48 to be essentially hidden from view so as not to impair the aesthetics of the instrument 10. The position and adjustment of the thumbwheel 48 is completely intuitive. One need not even look at the thumbwheel 48 to locate its position and rotate it the requisite amount for a predetermined adjustment degree. To access the thumbwheel 48, an individual need merely insert his thumb or fingers into the sound hole 22 between the strings 16. This may be accomplished while the strings 16 are in place with only minor subsequent tuning adjustments being required. In addition, there is no need for a key, wrench or any other mechanical tool to be utilized. Such adjustment is so quick and easy that it may be performed on stage between songs during a performance, even in low light situations. Once again, because there are no tools required, no alignment of a tool, such as a screwdriver or Allen wrench, is required to adjust the adjustment member.

Of course, the thumbwheel 48 may also be provided underneath the body of the guitar 10, as in the case of a solid body electric guitar. In such a case, the thumbwheel 48 may be provided in a suitably sized recess, so that the thumbwheel may still be finger manipulable.

No matter whether for an acoustic or electric guitar, the size of the thumbwheel 48 as well as the size and pitch of the threads on the threaded screw 46 may be varied as desired to achieve angular translation of the neck 14 relative to the body 12 of the guitar 10 in a controllable manner with a reasonable amount of force and number of thumbwheel 48 rotations. In this regard, typical thumbwheel sizes are in the order of 1½ to 3 inches in diameter and typical screw thread pitches are 20–40 threads per inch. In order to further ease rotation of the thumbwheel 48, preferred embodiments of the present invention utilize Delrin threaded inserts at the point where the action adjustment member 44 penetrates the instrument body 12.

Other finger manipulable elements may be provided in lieu of the thumbwheel 48. For example, the finger manipulable element may be a knurled roller, lever or other component which serves to provide leverage.

The neck mounting system for the guitar 10 shown in FIGS. 2 and 3 also includes an intonation adjustment mechanism 52, as well as a rigidity enhancement mechanism for ensuring that a solid, stable structural joint is provided. In this regard, the intonation adjustment mechanism and rigidity enhancement mechanism are generally in accord with the principles taught in U.S. Pat. No. 5,786,539, which is hereby incorporated by reference and Applicant's prior patent, U.S. Pat. No. 6,265,648 B1, discussed previously.

In addition, stringed musical instruments of the type described in applicant's prior patent, U.S. Pat. No. 6,265,648 B1, which were provided with a centered truss rod (not shown) for reinforcing the neck 14 and/or camber adjustment, as is typically provided in other stringed musical instruments, require that the action adjustment member 44 be offset from the centerline of the neck where the truss rod extends. However, with the present invention, in which the action adjustment member 44 is mounted completely below the neck 14, both the truss rod (not shown) and the adjustment member 44 may be located along the longitudinal centerline of the neck 14, allowing all the forces to be symmetrical and stable, and accordingly, providing a more efficient design for the instrument. Also, the truss rod can extend the full length of the neck 14.

Figure 4:
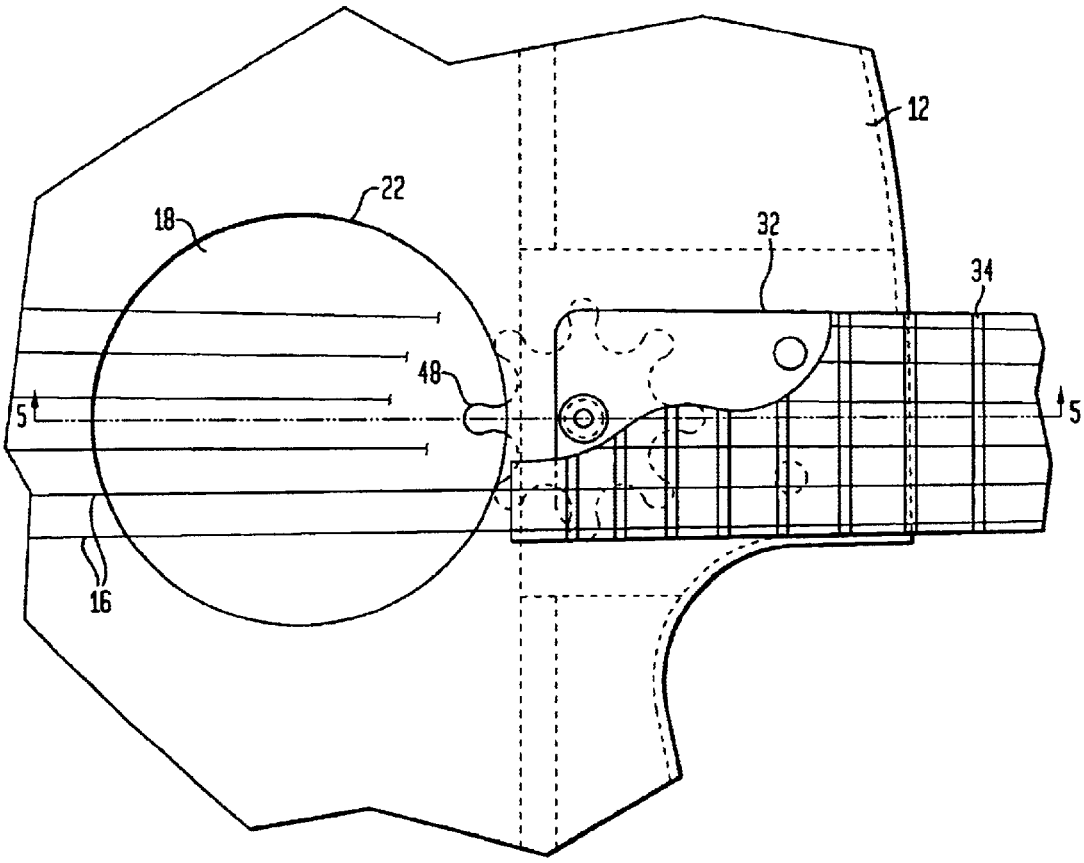
FIG. 4 is a partial plan view of a guitar, similar to that as in FIG. 2, which illustrates a further embodiment of the present invention in which no intonation adjustment is provided. Portions of FIG. 2 have been cut away for clarity.
Figure 5:
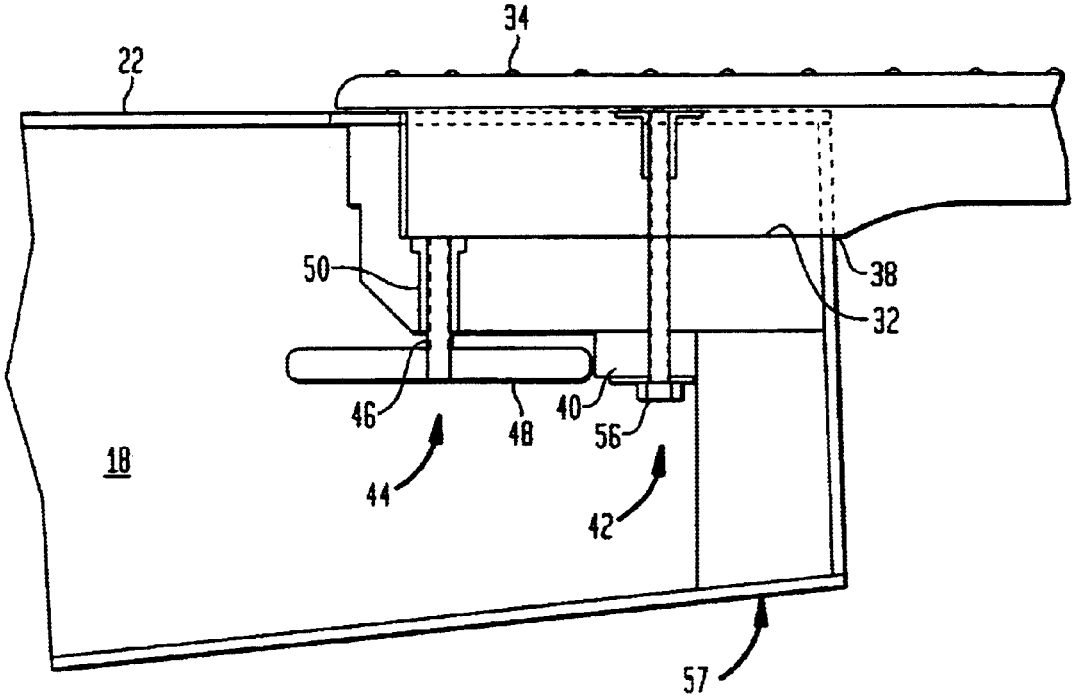
FIG. 5 is a side sectional view of the portion of the guitar shown in FIG. 4, taken along the longitudinal centerline of the instrument, which illustrates a vertically oriented holding member.

A second embodiment of the present invention is shown in FIGS. 4 and 5. This second embodiment depicts a guitar 10 in which no intonation adjustment mechanism 52 is provided, and in which the holding member 42 comprises a pair of bolts set generally normal to the top surface of the guitar body 12 through a flat rearward extension 40. Notably however, the important aspects of the present invention remain. For example, the embodiment shown in FIGS. 4 and 5 continues to employ a moveable adjustment member 44 which is finger manipulable and which is located within the hollow sound chamber 18 while being accessible through the sound hole 22. As in the first embodiment, the finger manipulable portion is shown as a thumbwheel 48 in this embodiment.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A stringed musical instrument comprising:

an instrument body having a fulcrum;

a neck extending outwardly from said instrument body in a longitudinal direction and arranged so as to be pivotable about said fulcrum on said body;

a plurality of strings attached to said body and said neck;

a holding member extending at least partially through said neck and said instrument body for securing said neck to said instrument body;

a movable adjustment member operatively engaging said neck and said body and being arranged so as to be moveable in a predetermined manner to adjust the angular position of said neck relative to said instrument body in useable increments throughout a predetermined range to thereby adjust the position of said strings relative to said neck, said adjustment member having a finger manipulable portion which is adapted to be engaged by the digits of a human hand to move said adjustment member in said predetermined manner.

2. The stringed musical instrument of claim 1, wherein said plurality of strings is attached directly to either or both of said body and said neck.

3. The stringed musical instrument of claim 1, wherein said finger manipulable portion comprises one of a thumbwheel, a knurled roller and a lever.

4. The stringed musical instrument of claim 1, further comprising a recess within said instrument body, and wherein said finger manipulable portion is located within said recess.

5. The stringed musical instrument of claim 1, wherein said body further comprises a neck recess, such that said neck extends outwardly from said neck recess in a longitudinal direction so as to be pivotal about said fulcrum.

6. The stringed musical instrument of claim 1, wherein said instrument body further includes a hollow sound chamber and a sound hole, and wherein said sound hole provides access into said hollow sound chamber.

7. The stringed musical instrument of claim 6, wherein said finger manipulable portion is located in said hollow sound chamber and is accessible from the exterior of the stringed musical instrument through said sound hole.

8. The stringed musical instrument of claim 1, wherein said predetermined manner of movement of said adjustment member is rotation of said finger manipulable portion.

9. The stringed musical instrument of claim 1, wherein said predetermined manner of movement of said adjustment member is translation of said finger manipulable portion.

10. The stringed musical instrument of claim 1 wherein said at least one holding member comprises a bolt having a shaft and a head, said shaft of said bolt being arranged so as to extend at least partially through said neck and said instrument body.

11. The stringed musical instrument of claim 10, wherein said holding member further includes a spring member to provide an additional force on said neck and said body, said spring member being arranged about said shaft of said bolt and positioned between said head of said bolt and one of said neck and said instrument body.

12. The stringed musical instrument of claim 11, wherein said spring member comprises a Belleville spring washer.

13. The stringed musical instrument of claim 1, wherein said holding member is inclined along a direction so that said force of said holding member includes a force component along said longitudinal direction of said instrument.

14. The stringed musical instrument of claim 1 further comprising an intonation adjustment mechanism.

15. The stringed acoustical musical instrument of claim 14, further comprising an intonation adjustment mechanism.

16. A stringed acoustical musical instrument comprising:

an instrument body having a fulcrum, a sound hole, and a hollow sound chamber;

a neck extending outwardly from said instrument body in a longitudinal direction and arranged so as to be pivotable about said fulcrum on said body;

a plurality of strings attached to said body and said neck;

a holding member extending at least partially through said neck and said instrument body for securing said neck to said instrument body;

a movable adjustment member operatively engaging said neck and said body and being arranged so as to be moveable in a predetermined manner to adjust the angular position of said neck relative to said instrument body in useable increments throughout a predetermined range to thereby adjust the position of said strings relative to said neck, said adjustment member having a finger manipulable portion which is at least partially located within the hollow sound chamber and is adapted to be engaged by the digits of a human hand to move said adjustment member in said predetermined manner.

17. The stringed acoustical musical instrument of claim 16, wherein said plurality of strings is attached directly to either or both of said body and said neck.

18. The stringed acoustical musical instrument of claim 16, wherein said finger manipulable portion comprises one of a thumbwheel, a knurled roller and a lever.

19. The stringed acoustical musical instrument of claim 16, wherein said body further comprises a neck recess, such that said neck extends outwardly from said neck recess in a longitudinal direction so as to be pivotal about said fulcrum.

20. The stringed acoustical musical instrument of claim 16, wherein said finger manipulable portion is accessible from the exterior of the guitar through said sound hole.

21. The stringed acoustical musical instrument of claim 16, wherein said predetermined manner of movement of said adjustment member is rotation of said finger manipulable portion.

22. The stringed acoustical musical instrument of claim 16, wherein said predetermined manner of movement of said adjustment member is translation of said finger manipulable portion.

23. The stringed acoustical musical instrument of claim 16, wherein said holding member comprises a bolt having a shaft and a head, said shaft of said bolt being arranged so as to extend at least partially through said neck and said instrument body.

24. The stringed acoustical musical instrument of claim 23, wherein said holding member further comprises a spring member to provide an additional force on said neck and said body, said spring member being arranged about said shaft of said bolt and positioned between said head of said bolt and one of said neck and said instrument body.

25. The stringed acoustical musical instrument of claim 24, wherein said spring member comprises a Belleville spring washer.

26. The stringed acoustical musical instrument of claim 16, wherein said one holding member is inclined along a direction so that said force of said holding member includes a force component along said longitudinal direction of said instrument.

27. A stringed musical instrument comprising: an instrument body having a fulcrum;

a neck extending outwardly from said instrument body in a longitudinal direction and arranged so as to be pivotable about said fulcrum on said body;

a plurality of strings attached to said body and said neck;

a holding member extending at least partially through said neck and said instrument body for securing said neck to said instrument body;

a movable adjustment member operatively engaging said neck and said body and being arranged so as to be moveable in a predetermined manner to adjust the angular position of said neck relative to said instrument body to thereby adjust the position of said strings relative to said neck, said adjustment member having a finger manipulable portion which is adapted to be engaged by the digits of a human hand to move said adjustment member in said predetermined manner; and wherein a recess is provided within said instrument body having a recess, and said finger manipulable portion is located within said recess.

28. A stringed musical instrument comprising:

an instrument body having a fulcrum;

a neck extending outwardly from said instrument body in a longitudinal direction and arranged so as to be pivotable about said fulcrum on said body;

a plurality of strings attached to said body and said neck;

a holding member extending at least partially through said neck and said instrument body for securing said neck to said instrument body;

a movable adjustment member operatively engaging said neck and said body and being arranged so as to be moveable in a predetermined manner to adjust the angular position of said neck relative to said instrument body to thereby adjust the position of said strings relative to said neck, said adjustment member having a finger manipulable portion which is adapted to be engaged by the digits of a human hand to move said adjustment member in said predetermined manner;

wherein said instrument body further includes a hollow sound chamber and a sound hole, and wherein said sound hole provides access into said hollow sound chamber; and wherein said finger manipulable portion is located in said hollow sound chamber and is accessible from the exterior of the stringed musical instrument through said sound hole.

29. A stringed musical instrument comprising:

an instrument body having a fulcrum;

a neck extending outwardly from said instrument body in a longitudinal direction and arranged so as to be pivotable about said fulcrum on said body;

a plurality of strings attached to said body and said neck;

a holding member extending at least partially through said neck and said instrument body for securing said neck to said instrument body; and a movable adjustment member operatively engaging said neck and said body and being arranged so as to be moveable in a predetermined manner to adjust the angular position of said neck relative to said instrument body to thereby adjust the position of said strings relative to said neck, said adjustment member having a finger manipulable portion which is adapted to be engaged by the digits of a human hand to move said adjustment member in said predetermined manner, wherein said predetermined manner of movement of said adjustment member is translation of said finger manipulable portion.

30. A stringed acoustical musical instrument comprising:

an instrument body having a fulcrum, a sound hole, and a hollow sound chamber;

a neck extending outwardly from said instrument body in a longitudinal direction and arranged so as to be pivotable about said fulcrum on said body;

a plurality of strings attached to said body and said neck;

a holding member extending at least partially through said neck and said instrument body for securing said neck to said instrument body; and a movable adjustment member operatively engaging said neck and said body and being arranged so as to be moveable in a predetermined manner to adjust the angular position of said neck relative to said instrument body to thereby adjust the position of said strings relative to said neck, said adjustment member having a finger manipulable portion which is at least partially located within the hollow sound chamber and is adapted to be engaged by the digits of a human hand to move said adjustment member in said predetermined manner; and wherein said finger manipulable portion is accessible from the exterior of the guitar through said sound hole.

31. A stringed acoustical musical instrument comprising:

an instrument body having a fulcrum, a sound hole, and a hollow sound chamber;

a neck extending outwardly from said instrument body in a longitudinal direction and arranged so as to be pivotable about said fulcrum on said body;

a plurality of strings attached to said body and said neck;

a holding member extending at least partially through said neck and said instrument body for securing said neck to said instrument body; and a movable adjustment member operatively engaging said neck and said body and being arranged so as to be moveable in a predetermined manner to adjust the angular position of said neck relative to said instrument body to thereby adjust the position of said strings relative to said neck, said adjustment member having a finger manipulable portion which is at least partially located within the hollow sound chamber and is adapted to be engaged by the digits of a human hand to move said adjustment member in said predetermined manner, wherein said predetermined manner of movement of said adjustment member is translation of said finger manipulable portion.

* * * * *